US005408445A

United States Patent [19]

Allgaier et al.

[11] Patent Number: 5,408,445

[45] Date of Patent: Apr. 18, 1995

[54] RADIO TIMEPIECE

[75] Inventors: Jürgen Allgaier, Lauterbach; Wolfgang Ganter, Schramberg; Wolfram Hodapp, Schenkenzell, all of Germany

[73] Assignee: Junghans Uhren GmbH, Schramberg, Germany

[21] Appl. No.: 931,389

[22] Filed: Aug. 18, 1992

[30] Foreign Application Priority Data

Aug. 23, 1991 [DE] Germany ..... 9110462 U

[51] Int. Cl.[6] ..... G04C 11/02; G04B 19/22

[52] U.S. Cl. ..... 368/47; 368/21

[58] Field of Search ..... 368/21–24, 368/41–54

[56] References Cited

U.S. PATENT DOCUMENTS

| | | | |
|---|---|---|---|
| 4,645,357 | 2/1987 | Allgaier et al. | 368/47 |
| 4,681,460 | 7/1987 | Nishimura | 368/47 |
| 4,998,229 | 3/1991 | Kubota | 368/47 |
| 5,007,033 | 4/1991 | Kubota et al. | 368/47 |
| 5,077,706 | 12/1991 | Ganter | 368/47 |
| 5,150,396 | 4/1992 | Ganter et al. | 368/47 |

FOREIGN PATENT DOCUMENTS

| | | |
|---|---|---|
| 0219700 | 4/1987 | European Pat. Off. . |
| 0308881 | 3/1989 | European Pat. Off. . |
| 0439725 | 8/1991 | European Pat. Off. . |
| 1411310 | 10/1975 | United Kingdom . |

OTHER PUBLICATIONS

Schmuck & Uhren, "Collectionen '87," Feb. 1987, p. 81.

*Primary Examiner*—Bernard Roskoski

*Attorney, Agent, or Firm*—Burns, Doane, Swecker & Mathis

[57] ABSTRACT

A radio timepiece is disclosed which receives and decodes a time information signal from a remote transmitter and displays a time information. The timepiece includes a manual time zone switching circuitry deigned to permit use of the timepiece in time zones adjacent to the one in which the transmitter is located, while providing a user-friendly selection and display of the time information. The timepiece includes an electro-optical display providing a cartographical representation of the transmitter time zone and several adjacent time zones. A summing register is provided to manually offset the received time information and actuate a graphic display indicative of the time zone to which the offset time display corresponds. The summing register may be cyclically incremented by a single switch, or incremented, decremented or zeroed by appropriate actuation of two switches.

7 Claims, 1 Drawing Sheet

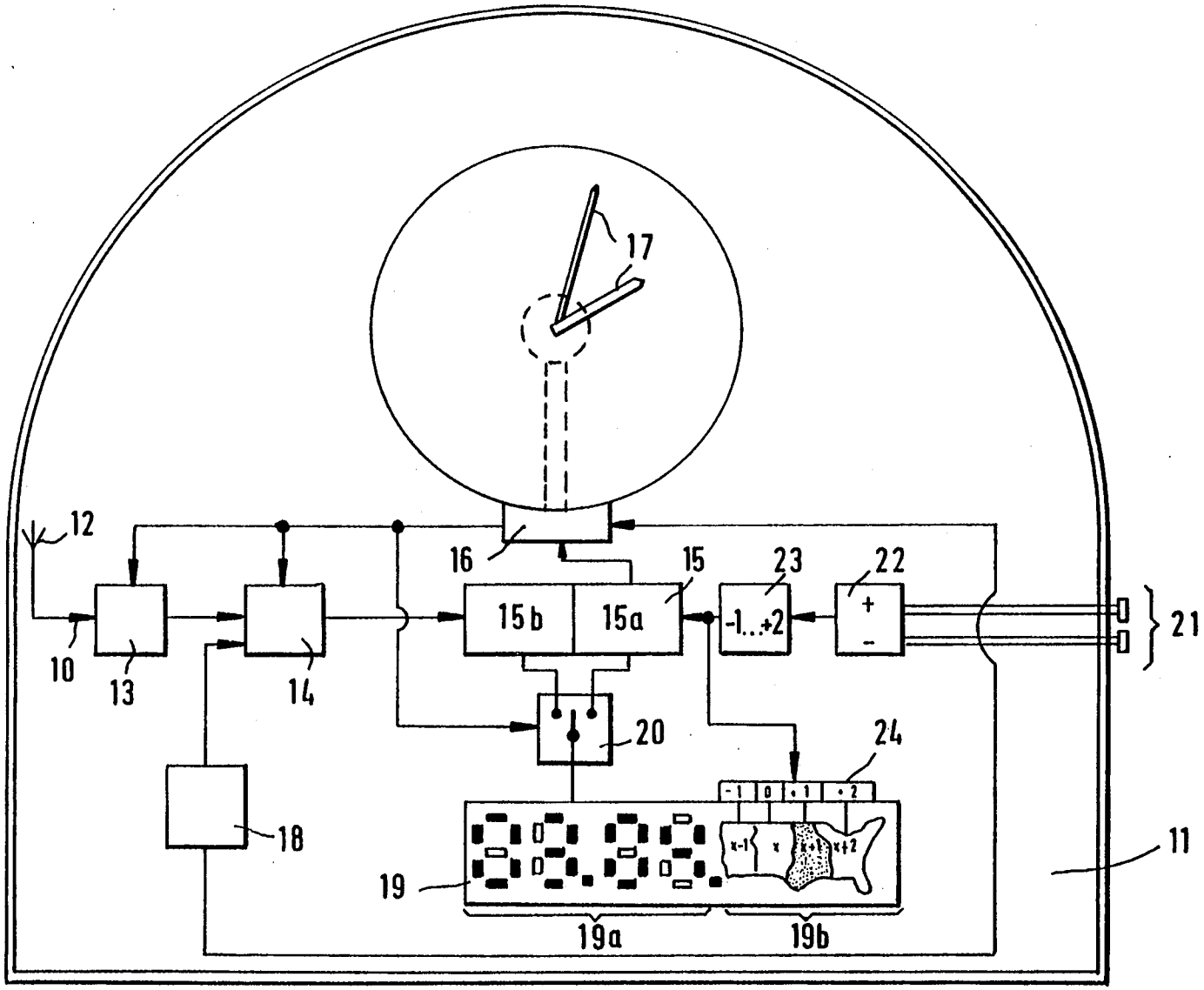
21
11
22
+
-
23
-1...+2
24
19b
15
15a
15b
20
19a
17
16
19
14
18
13
12
10

RADIO TIMEPIECE

RELATED INVENTIONS

This disclosure relates to timepieces which receive time information from an external radio source. More particularly this disclosure presents a time zone switching function and display for such timepieces.

This invention is related to the subject matter described in U.S. Pat. No. 5,105,396 and U.S. Pat. No. 5,077,706.

BACKGROUND OF THE INVENTION

Timepieces which receive time information from an external radio source or transmitter are known as shown in EP 0 439 725 A2. The hour display may be altered manually in hourly steps, corresponding to a time display in successive geographic time zones. Typically the broadcast time signal is the local time of the transmitter, i.e. the correct time in the time zone in which the transmitter is located. Because of the potential for poor reception, the receiver is conveniently blocked if the timepiece is located too far away from a transmitter of absolute coded time signals.

SUMMARY AND OBJECTS

Under proper circumstances, it may be practical to occasionally receive a time signal at a distance of several time zones from the transmitter and to use it to monitor the time display in the time zone of the prevailing location. This is of particular interest whenever a centrally located transmitter is designed to cover several adjacent time zones, such as, for example, in the USA where the four national time zones are adequately covered, but where the real time signal gives only the instantaneous time in the zone in which the transmitter is located. If the user of the timepiece resets the received time up or down by, for example, one or two hours (corresponding to one of the nearby time zones to the east or west), confusion may be created as to which time zone the currently displayed time corresponds.

In recognition of these conditions, it is the object of the invention to provide a timepiece which receives time information from an external radio source having an easily interpreted display of the time correlated to the appropriate time zone.

This and other objects are achieved by providing a timepiece for receiving and decoding time information indicative of the local time of a time zone in which the time information transmitter is located. The timepiece includes a display of the time responsive to the received time information signal. An electro-optical display means includes a cartographical representation of the transmitter time zone and several nearby time zones. The timepiece is switchable to manually offset the time display by whole hour increments and to cartographically indicate the time zone corresponding to the offset.

By combining a cartographic data indication with the manually entered time zone and the change in display accompanying it, the timepiece unambiguously indicates to which time zone the instantaneously displayed clock time belongs. The arrangement also facilitates the manual setting of the time zone desired, relative to which the valid clock time is of interest, regardless of whether the person carrying out the setting is present in said zone or not. In the process, by means of a single switch the entire scale of available time zones may be switched through in succession, by counting the hour information cycling up and down. If two actuation possibilities are provided, for example two different push button switches, the deviation from the hourly information transmitted by the sender may be counted up in steps using one switch and down with the other. Additionally, the timepiece may be reset to display to the local time of the transmitter by actuating both switches simultaneously.

In the case of a timepiece with hands, the entered time zone information is conveniently displayed as a graphical image in an auxiliary display. In addition, for example, alpha-numerical calendar information, such as those known from EP 0 308 881 A2 may be displayed by the timepiece.

It is known in principle to indicate on a world map the latitude division by time zones, for example in a mercator projection, and to provide query switches in certain geographic locations, upon the actuation of which the local time is displayed See "Schmuck & Uhren", No. 2/1987, page 81, bottom left. However, there the local display remains unchanged as the normal display, even if said local display is temporarily replaced by the local time of the point selected on the map display.

The restriction of the cartographic display to a few time zones on either side of the zone of the transmitter location has, according to the invention, the further advantage compared to a global representation that it provides an indication of the areas outside of which the reception of time information signals is unreliable or impossible.

These and other objects and features of the present invention will be apparent from the written description and drawings provided in this application. While the detailed description focuses on a preferred embodiment of the invention, the scope of the invention is not intended to be limited to that embodiment.

BRIEF DESCRIPTION OF THE DRAWING

The sole Figure is a schematic block diagram of a timepiece for receiving time information from an external transmitter, and for displaying the time and a geographical representation of manually entered time zone information.

DETAILED DESCRIPTION OF THE PREFERRED EMBODIMENTS OF THE INVENTION

As shown in detail for example in U.S. Pat. No.4,645,357, an autonomous radio-controlled timepiece 11 may comprise a long-wave antenna 12 for the reception of time information signals 10, e.g. coded information indicative of the beginning of each minute. This information is decoded in a receiving and decoding circuit 13. The decoded information is evaluated in a test circuit 14 for plausibility. If confirmed by the test circuit, the information signal is applied to a control register 15 as a binary number. The prevailing hour and minute information from the time component **15*a* of the control register 15 is queried by a positioning device 16, which contains setting means for the time display. In this embodiment, the time display is affected by positioning the time display hands 17. The positioning device 16 positions the hands to coincide with the instantaneous information from the time component of the control register 15. As required, the hands 17 may be moved rapidly into the time correct angular position by an internal quartz-stabilized oscillator 18 operated at an accelerated cycle rate. If the display position of the hands 17 is correct, the positioning device 16 transmits a switching signal to the testing circuit 14, whereupon the oscillator 18 updates the contents of the time component 15***a* of the control register 15.

In the case of a battery operated radio timepiece, in order to save energy, the receiving and decoding circuit 13 may be deactivated once the radio time information has been used to set the timepiece. The receiving and decoding circuit may be reactuated after a certain period of time (for example once every hour), in order to test the advanced instantaneous position of the hands 17 in accordance with the received time information signal 10 relative to the time displayed and correct the time display if necessary.

During the correction of the hands 17, the time information decoded from the information signal 10 in the time component 15*a* of the control register 15 may be displayed in an electro-optical display 19 in an alphanumerical area 19*a*. Such an intermittent display is known in the art in connection with digital timepieces with power saving liquid crystal displays (See, for example, British Patent No. 1,411,310). If the hands 17 are employed as the continuous display of time, the alphanumerical area 19*a* of the electro-optical display 19 may be switched by switch 21 to display other information. This alternatively displayed information may be decoded from the time information signal 10 and contained in the control register 15, such as digital date and/or day of the week information in the calendar component 15*b* of the control register 15. The contents of the calendar component may be advanced by internal oscillator 18, i.e. by the transfer of information from the time component 15*a* of the control register. This information is corrected as needed on the basis of the decoded time information signal 10 when the receiving and decoding circuit 13 is activated.

At least one switch 21, preferably in the form of a push button switch, is accessible from outside the case of the radio timepiece 11. The switch may advance or actuate a pulse generator 22 which increments a summing register 23. The summing register can be incremented until it reaches its capacity, at which point it returns to its initial value. If two switches 21 are provided, upwards counting (+) or down counting (−) information may be transferred to the summing register 23. Upper and lower counting capacity limits correspond to the number of individually selectable time zones. The hour information in the time component 15*a* of the control register is increased or decreased by the content of the summing register 23. This causes a whole hour change in the displayed time, which corresponds to changes of a geographic time zone (geographic latitude displacement by 15°). If, therefore, the time information signal 10 received by radio is assigned to a given time zone x, the content "+1" of the summing register 23 increases the hour information in the time component 15*a* of the control register by one hour, which corresponds to the prevailing time in the time zone x+1 displaced from the original time zone x by one to the east. A single actuation of one of the switches 21 increases, for example, the content of the time component 15*a* of the control register by one hour, resulting in a corresponding correction of the display position of the hour hand. A separate drive may be provided to advance the hour hand by 30°. Similarly, a single actuation of the other of the switches 21 causes a deduction of one hour from the time component 15*a* of the control register, corresponding to a time displacement by one time zone to the west (x−1). The positioning device may respond by moving the hour hand backwards by one hour (or by advancing the hour hand 11 hours, to avoid the mechanical and electrical complexities of reversing the hand drive). If both switches 21 are actuated simultaneously, the contents of the summing register 23 is canceled and the content of the time component 15*a* of the control register, i.e. the prevailing time display by the hands 17, again corresponds to the time given in the time zone x, for which the time information signal 10 is transmitted.

To enable the user to immediately determine whether the instantaneous time display of the hands 17 belongs to a manually selected time zone or belongs to the time zone of the time information signal transmitter, a continuous display could be provided of a number corresponding to the time zone for which the displayed time is appropriate. However, such a numerical display may be confusing to the average user. Accordingly, in a preferred embodiment, the vicinity of the geographic zone for which the radio timepiece 11 is intended, is displayed by means of a cartographic view in the graphic area 19*b* of the electro-optical display 19. A time information signal may be received from one of these nearby time zones (for example in case of favorable receiving conditions at night). Instead of digital and letter segments in the alphanumerical area of the 19*a*, cartographic areas are actuated corresponding to the prevailing content of the summing register 23. If the content of the summing register is zero the area (x) assigned to the original time zone (of the time information signal transmitter) will be actuated. This graphical area 19*b* of the electro-optical display 19 may again be in the form of a liquid crystal display with different electrode areas, which are lit up selectively by means of a zone control device 24 acting as a switch. For the display of the outlines of the cartographic area and the time zone boundaries, permanent symbols may be built into the display, such as described for example in EP 0 219 700 A2. In the preferred embodiment of the Figure, the graphical display area 19*b* contains a rough representation of the four time zones of the USA, each which is assigned to a display electrode. The zone control 24 actuates the electrode corresponding to with the instantaneous content of the summing register 23. In the example shown in the Figure, the summing register 23 contains the value "+1", i.e. the display of the hands 17 corresponds to the prevailing time zone x+1 displaced by one unit from the original time zone x toward the east.

Although the present invention has been described with reference to preferred embodiments, it will be appreciated that modifications not specifically described here may be made by one skilled in the art which are nevertheless within the scope of the invention defined in the following claims.

What is claimed is:

1. A timepiece for displaying time information received from a remote transmitter, said timepiece comprising:

means for receiving and decoding a time information signal indicative of a local time;

means for displaying the time responsive to said received time information signal, wherein said display means includes an analog display for displaying time using an analog mechanism;

electro-optical display means for providing a graphical representation of a first time zone and at least one time zone adjacent to the first time zone, wherein said electro-optical display means includes, in addition to an area providing the graphical representation of plural time zones, an area providing an alpha-numeric display of time to be displayed said analog display during a change in setting of said analog display; and switchable means for manually offsetting received time information to be displayed by at least one whole hour increment and actuating the graphic display of a graphical representation of a corresponding time zone.

2. The timepiece according to claim 1, wherein the switchable means includes a summing register.

3. The timepiece according to claim 2, wherein at least one switch is provided for varying the content of the summing register in hour increments.

4. The timepiece according to claim 3, wherein two switches are provided for additive or subtractive variation of the content of the summing register.

5. The timepiece according to claim 4, wherein a zero setting of the summing register is provided with the simultaneous actuation of both switches.

6. The timepiece according to claim 1, wherein said area providing an alpha-numeric display selectively displays calendar information decoded from the received time information signal.

7. The timepiece according to claim 1, wherein said electro-optical display means includes at least one liquid crystal cell with actuating electrodes having a cartographic configuration corresponding to the first time zone and plural nearby time zones, which display means includes permanent symbol markings corresponding to the boundaries of said time zones.

* * * * *